US007340913B2

(12) United States Patent
Miller et al.

(10) Patent No.: US 7,340,913 B2
(45) Date of Patent: Mar. 11, 2008

(54) ICE MACHINE AND ICE-MAKING ASSEMBLY INCLUDING A WATER DISTRIBUTOR

(75) Inventors: Richard T. Miller, Manitowoc, WI (US); Marty J. Lafond, Algoma, WI (US); Howard G. Funk, Manitowoc, WI (US)

(73) Assignee: Manitowoc Foodservice Companies, Inc., Sparks, NV (US)

( * ) Notice: Subject to any disclaimer, the term of this patent is extended or adjusted under 35 U.S.C. 154(b) by 297 days.

(21) Appl. No.: 11/192,693

(22) Filed: Jul. 29, 2005

(65) Prior Publication Data

US 2006/0026986 A1 Feb. 9, 2006

Related U.S. Application Data

(60) Provisional application No. 60/599,340, filed on Aug. 5, 2004.

(51) Int. Cl.
*F25C 1/12* (2006.01)

(52) U.S. Cl. ..... 62/347; 239/193

(58) Field of Classification Search ..... 62/74, 62/347; 239/193, 548, 553.3, 556, 566, 568
See application file for complete search history.

(56) References Cited

U.S. PATENT DOCUMENTS 2,952,996 A 9/1960 MacLeod
3,580,008 A 5/1971 Barnard et al.
4,267,978 A 5/1981 Manteufel
4,458,503 A * 7/1984 Nelson ..... 62/347
4,601,178 A * 7/1986 Suyama et al. ..... 62/347
4,986,088 A * 1/1991 Nelson ..... 62/347
5,193,357 A 3/1993 Kohl et al.
5,493,872 A * 2/1996 Hibino et al. ..... 62/347
5,520,011 A * 5/1996 Hibino ..... 62/347
5,586,439 A 12/1996 Schlosser et al.
5,992,167 A 11/1999 Hill et al.
6,148,621 A 11/2000 Byczynski et al.
6,311,501 B1 11/2001 Allison et al.
6,349,557 B1 2/2002 Gresham

* cited by examiner

*Primary Examiner*—William E. Tapolcai
(74) *Attorney, Agent, or Firm*—Brinks Hofer Gilson & Lione

(57) ABSTRACT

An ice machine has an ice-making assembly that includes a water distributor in which one or more structural elements form a first chamber. The first chamber is configured to receive an inflow of water, distribute the water laterally, and to controllably release the water. A mating member cooperates with the one or more structural elements to form a second chamber. The second chamber is configured to receive water from the first chamber and to controllably release the water onto a receiving surface. The mating member is configured to be detached from the one or more structural elements in a direction perpendicular to the direction of lateral water distribution.

6 Claims, 8 Drawing Sheets

ICE MACHINE AND ICE-MAKING ASSEMBLY INCLUDING A WATER DISTRIBUTOR

This application claims priority to U.S. Provisional patent application Ser. No. 60/599,340, filed Aug. 5, 2004.

TECHNICAL FIELD

The present invention relates, generally, to ice making machines and, more particularly, to ice-making assemblies and water distribution systems for ice machines.

BACKGROUND

Commercial ice-making equipment typically produces clear ice cubes rather than clouded ice cubes. Clouded ice cubes are typically formed in domestic or residential ice makers found in refrigerators, and the like. These typical residential ice makers form ice cubes by depositing water into a mold attached to an evaporator or an ice tray and allowing the water to freeze in a sedentary state. Ice cubes formed in this manner are clouded because air and impurities become trapped in the water as it freezes. Clear ice-making machines, on the other hand, form ice by flowing water over a chilled surface. As the water flows over the chilled surface, layers of ice are formed without trapping air within the layers of ice.

In a typical commercial ice machine, water flows over a vertically disposed evaporator plate. The evaporator plate includes a plurality of pockets or cells in which ice cubes are formed. The ice cubes are harvested by heating the evaporator plate to a temperature sufficient to release the ice cubes from the cells. Such a system is disclosed, for example, in commonly-assigned U.S. Pat. No. 5,586,439 to Schlosser et al., which is incorporated by reference herein.

In most commercial clear ice systems, water is circulated through the system from a water reservoir by a water circulation pump. The water is pumped to a water distributor that distributes water across the evaporator plate or ice-forming mold. Unfrozen water flows down the face of the mold. A water curtain catches any water splash and unfrozen water is returned to a water reservoir. An ice thickness sensor detects the thickness of the ice forming on the mold. When a desired thickness is reached, the sensor signals the ice forming machine to terminate the freeze cycle and begin a harvest cycle.

One such commercial ice machine system is schematically illustrated in FIG. 1. A water supply plumbed to the machine provides water to a water sump 12. Water sump 12 is equipped with a level controller 14 and a drain line 16 is equipped with a solenoid dump valve 18. A water pump 20 circulates water from water sump 12 to a water distributor 22. Water from water distributor 22 is directed across an ice-forming mold 24. Water that does not freeze on a first pass over ice-forming mold 24 flows into the water sump 12. A water curtain 26 collects splashing water and also directs it into the water sump 12.

As shown in the schematic diagram of FIG. 1, a prior art water distributor 22 is essentially a tube-within-a-tube design. An interior tube 28, made from two separately molded parts, is positioned within an outer tube 30. Water pumped by water pump 20 flows into interior tube 28, which has a series of openings in a lower portion of the tube. From interior tube 28, water flows into the annular space between interior tube 28 and outer tube 30. Outer tube 30 also includes a series of openings in a lower portion of the tube through which the water flows onto ice-forming mold 24.

While water distributor 22 is effective in delivering a fairly uniform stream of water across the entire width of ice-forming mold 24, considerable water pressure is necessary to charge interior tube 28 with water for delivery to ice forming mold 24. Further, ice-making assemblies, such as that illustrated in FIG. 1, require periodic cleaning to ensure that the clear ice is not contaminated. Thorough cleaning of water distributor 22 requires that the water distributor be disassembled. While the disassembly steps of water distributor 22 are straightforward, reassembly can require careful alignment and proper placement of o-rings that seal the various sections inside the distributor. Also, a small brush must be used to clean holes through which water flows out of the inner and outer tubes. Further, the tubes are molded with a long central core, which is complicated and limits the lengths of the tubes. Thus, considerable time can be required to clean and complete the reassembly once the cleaning process is complete.

Non-tubular water distributors for clear ice making machines have been designed for delivering water to an ice-forming mold. For example, U.S. Pat. No. 6,148,621 to Byczynski et al., which is incorporated by the reference herein, describes one such non-tubular water distributor. This patent describes a water distributor that introduces water onto a floor containing a series of barriers. Water pumped into the water distributor flows over a rear edge of the floor and onto an ice-forming mold. The ice-making assembly described by Byczynski et al. is designed for a low volume ice making machine having a capacity of about 30 to about 50 pounds of ice per day. Such low volume systems do not have the water handling requirements of a large commercial system. While the water distributor described by Byczynski et al. is effective at delivering water to an ice-forming mold in a small system, it is inadequate to operate at low water pressure and still distribute water evenly across an ice-forming mold as used in an ice-making assembly for a larger commercial unit. Such large ice making machines, having an ice-forming mold with a width of 20 inches or more, typically have production capacities of about 200 to about 2500 pounds of ice per day. Furthermore, the water distributor needs to be easily disassembled and reassembled for cleaning and should present minimal resistance to water flow.

BRIEF SUMMARY

In accordance with an embodiment of the invention, there is provided, in one embodiment a water distributor that includes a water inlet and a trough connected to the water inlet. The trough has an inner wall and an outer wall. The outer wall has a plurality of channels in a bottom edge thereof. A mating member is spaced apart from the outer wall and has a plurality of cut outs in a bottom edge. The plurality of cut outs in the mating member cooperate with the plurality of channels in the bottom edge of the outer wall to form water outlet openings.

In another aspect of the invention, a water distributor for an ice machine includes an elongated trough having a water inlet, a floor, and an outer wall. The outer wall has a plurality of slots along an upper edge thereof. A flow plate extends below the floor and includes a plurality of grooves therein. A mating member has a plurality of cut outs that align with the plurality of grooves in the flow plate to form water outlet openings. A housing supports the elongated trough and the mating member and has an opening accommodating the water inlet.

In yet another aspect of the invention, an ice making machine has an ice-making assembly. The ice-making assembly includes an ice-forming mold and a water distributor positioned above the ice-forming mold. The water distributor includes a trough having an inner wall and an outer wall. The outer wall has a series of weirs in an upper edge and a plurality of channels in a bottom edge. The series of weirs regulates the flow of water over the upper edge of the outer wall. A mating member overlies the trough and is spaced apart from the outer wall. The mating member has a plurality of cut outs in a bottom edge. The plurality of cut outs in the mating member cooperates with the plurality of channels in the outer wall to form water outlet openings. The housing supports the trough and the mating member and has a spillway positioned below the water outlet openings. The spillway is configured to provide an evenly distributed water stream over the ice-forming mold.

In still another aspect of the invention, an ice-making assembly for an ice machine includes a water holding unit having a water inlet and a series of weirs in an outer wall. A flow plate extends below the series of weirs and has a plurality of indentations resides in a lower edge of the flow plate. A mating member overlies the outer wall and the water holding unit and is spaced apart from the flow wall. The mating member has a plurality of cut outs in an end surface thereof. The plurality of cut outs align with the plurality of indentations to form water outlet openings. A housing having an opening accommodating the water inlet includes a spillway position below the water outlet openings. An ice forming mold is positioned down stream from the spillway.

In a still further aspect of the invention, a water distributor for an ice machine includes a first member having an outer wall, the outer wall having a plurality of channels therein. A second member is spaced apart from the outer wall and includes a plurality of cut outs in an edge thereof. The plurality of cut outs align with the plurality of channels to form water outlet openings, such that the water outlet openings can be split apart by disassembling the first and second mating members.

In a further aspect of the invention, a water distributor includes one or more structural elements forming a first chamber. The first chamber is configured to receive an inflow of water, to distribute the water laterally, and to controllably release the water. A mating member cooperates with the one or more structural elements to form a second chamber. The second chamber is configured to receive water from the first chamber and to controllably release the water onto a receiving surface. The mating member is configured to be detached from the one or more structural elements in a direction perpendicular to the direction of lateral water distribution.

DETAILED DESCRIPTION OF THE DRAWING AND THE PREFERRED EMBODIMENTS

The preferred embodiment of the present invention is for an ice-making assembly for a ice machine that includes a water distributor, and for an ice machine having the ice-making assembly. In one embodiment, the water distributor is positioned above an ice-forming mold. As will become apparent from the following description, the water distributor in the ice-making assembly can be easily disassembled for cleaning. Further, the design features of the water distributor avoid excessive back pressure in the water circulation system by minimizing pressure building up, accordingly, less pumping capacity or output pressure is necessary to circulate water through the ice-making assembly. Moreover, the ease with which the water distributor can be disassembled has practical benefit in that cleaning maintenance on the system requires less time because disassembly and reassembly can be quickly carried out. By reducing the time necessary to perform cleaning maintenance, ice-making machines having such an ice-making assembly will benefit from frequent cleaning, thus increasing the over all efficiency of the ice machine. Also, because the water distributor has an open configuration, as opposed to a tube-within-a-tube-configuration, ice machines having such an ice-making assembly can operate at high efficiency despite a lack of frequent cleaning maintenance. An ice making machine configured to incorporate the water distributor described and claimed herein is disclosed in commonly-assigned, co-pending U.S. patent application entitled "Ice Machine Including A Condensate Collection Unit, An Evaporator Attachment Assembly, And Removable Sump," having Ser. No. 10/913,787 and filed on even date herewith, the disclosure of which is incorporated by reference herein.

Figure 1:
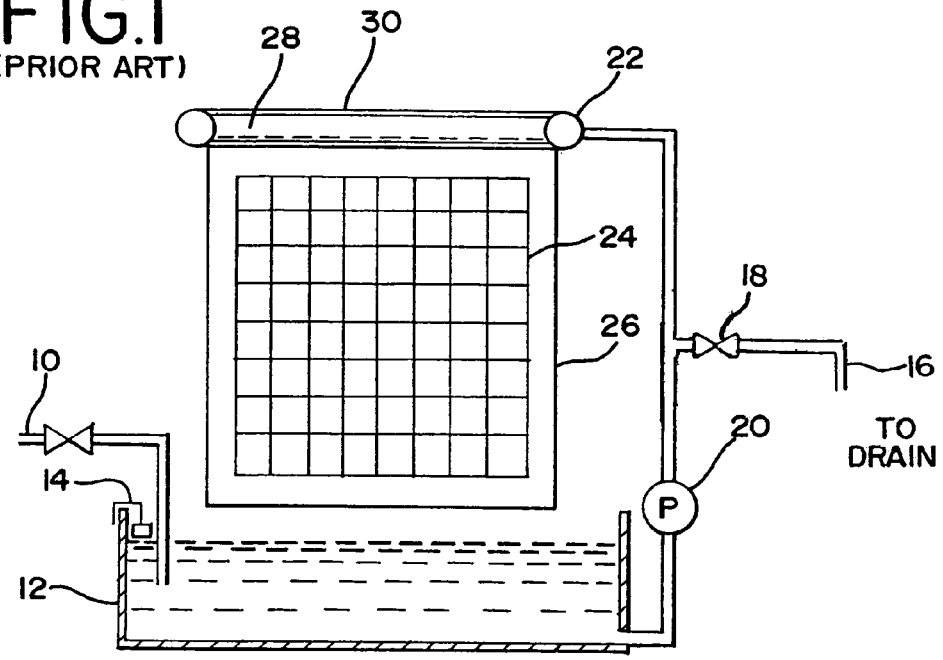
FIG.1 (PRIOR ART)
FIG. 1 is a schematic diagram of an ice-making assembly arranged in accordance with the prior art.
Figure 2:
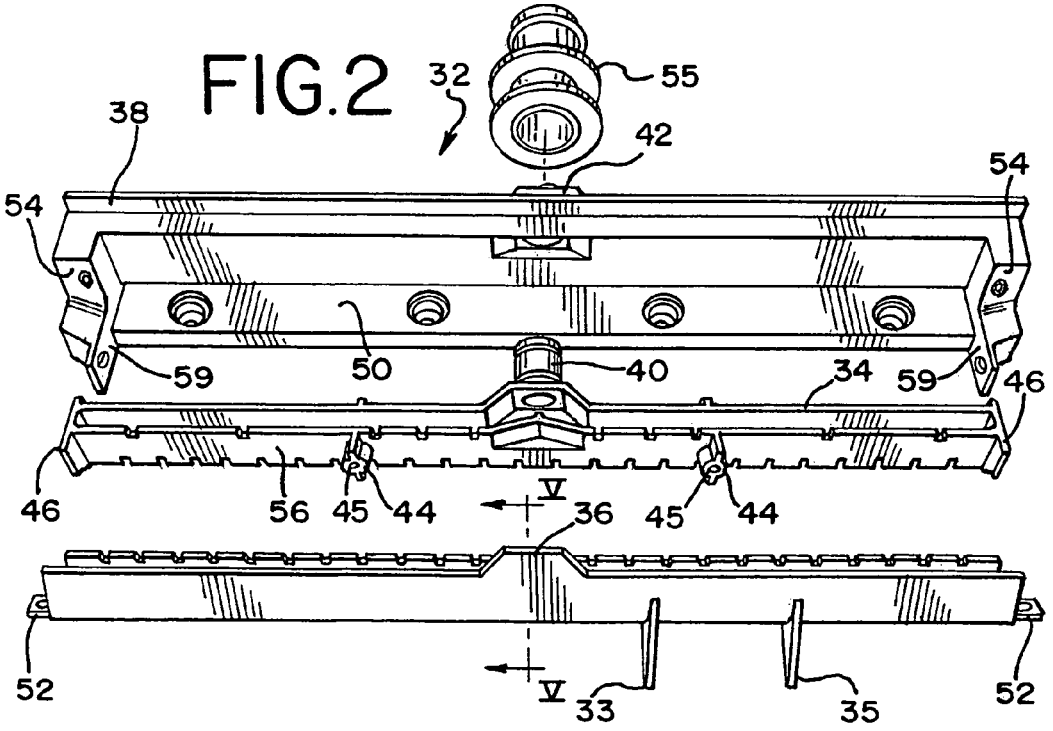
FIG. 2 is an exploded view of a water distributor in accordance with one embodiment of the invention.

A preferred water distributor is made from only three molded plastic parts, none of which require long core molding used to make the tube sections in the prior art distributor. This makes manufacturing of the water distributor easier. These and other advantages of the invention will become apparent upon review of the following description. Illustrated in FIG. 2 is an exploded view of a water distributor 32 configured in accordance with one embodiment of the invention. Water distributor 32 includes a water holding unit 34, which in a preferred embodiment is a trough, a mating member 36, and a housing 38. Trough 34 includes a water inlet tube 40 that inserts into an opening 42 in housing 38. Trough 34 also includes struts 44 positioned on a wall opposite to and on both sides of water inlet tube 40. Threaded brass inserts 45 (also shown in FIG. 12) are positioned within struts 44 to accommodate attachment of matting member 36 to trough 34 by screws (not shown) that thread into inserts 45 through holes 92 (shown in FIG. 10). A fitting 55 couples with inlet tube 40 and includes flanges that abut against in inner and outer surface on an interior machine support (not shown) within the ice machine.

Figure 3:
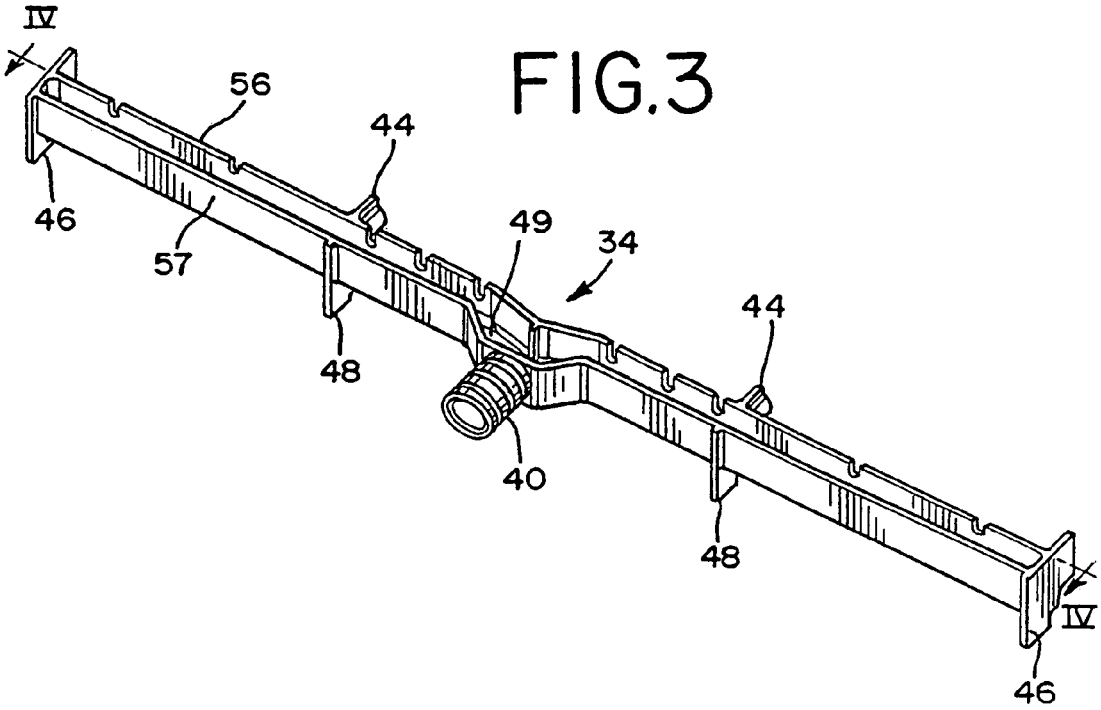
FIG. 3 is a perspective view of a trough or a water holding unit of the water distributor illustrated in FIG. 2.

A more detailed view of trough 34 is illustrated in the perspective view of FIG. 3. Trough 34 includes end walls 46 and legs 48. Referring to FIGS. 2 and 3, when water distributor 32 is assembled, end walls 46 and legs 48 rest against a floor 50 of housing 38. Further, water inlet tube 40 inserts into opening 42 and wing panels 52 of mating member 36 abut against landings 54 of housing 38. Holes in wing panels 52 align with holes in landings 54 to accommodate attachment of matting member 36 to housing 38. The holes in landings 54 are also equipped with threaded brass inserts. Housing 38 also includes brackets 59 extending outwardly from landings 54. Brackets 59 include holes therein for use in hanging a water curtain (not shown) in front of ice-forming mold 96 (shown in FIG. 13). Bosses 33 and 35 on the outside surface of mating member 36 include holes for suspending an ice thickness sensor.

As will subsequent are described, once assembled, trough 34 stands off from housing floor 50 and portions of mating member 36. As best shown in FIG. 3, trough 34 includes an outer wall 56 from which struts 44 and portions of end walls 46 protrude. A portion of end walls 46 and legs 48 extend below a bottom surface or floor 49 of trough 34. Struts 44, end walls 46, and legs 48 contact interior surfaces of housing 38 to support trough 34 within the housing.

Figure 4A:
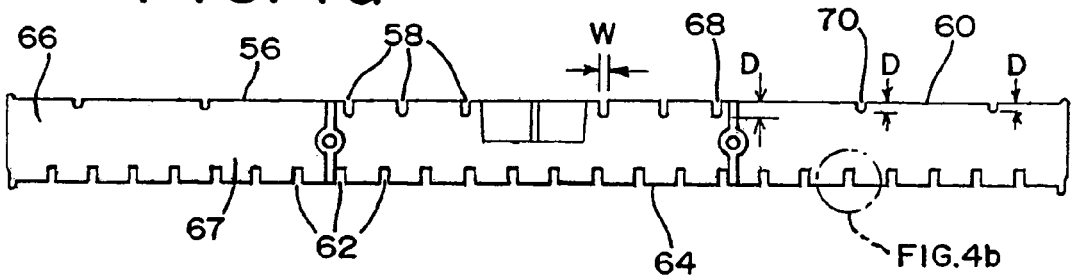
FIG. 4*a* is side view of an outer wall of the trough shown in FIG. 3.

A cross sectional view of outer wall 56 taken along section line IV-IV of FIG. 3 is illustrated in FIG. 4*a*. Outer wall 56 has a series of weirs 58, which can be slots or other type openings, at an upper edge 60 of outer wall 56. Outer wall 56 also includes a plurality of channels, indentations, or grooves 62 at a bottom edge 64 of outer wall 56. Weirs 58 regulate the flow of water from trough 34 over a flow surface 66 of outer wall 56. Channels 62 are formed in a flow plate 67 that extends downwardly from floor 49 and forms the lower portion of outer wall 56. In accordance with an embodiment of the invention, the number of weirs 58 and the positioning of the weirs can vary along upper edge 60 of outer wall 56. Further, the depth, designated as "D," and the width, designated as "W," can vary depending upon water flow requirements. As illustrated in FIG. 4*a*, the depth of an inner weir 68 is greater than the depth of an outer weir 70. The depth relationship between inner weir 68 and outer weir 70 compensates for the differential lateral water velocity in trough 34 in relation to the distance from water inlet tube 40. To maintain uniform water flow across trough 34, the faster moving water near water inlet tube 40 requires larger and more numerous weirs than does the slower moving water near outer walls 46.

Figure 4B:
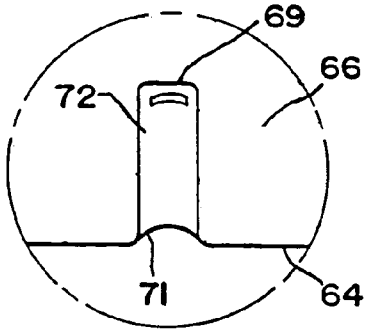
FIG. 4*b* is an enlarged view showing a portion of the outer wall illustrated in FIG. 4*a;*

At bottom edge 64, channels 62 are formed by a series of grooves in flow surface 66. An enlarged view of one such channel 69 is shown in FIG. 4*b*. Channel 69 is a semi-circular groove or indentation formed in flow surface 66. Channel 69 includes a semi-circular edge 71 and an inner surface 72 that extends along outer wall 56 from the bottom edge 64 toward upper edge 60. The length of inner surface 72 can vary depending upon the particular design parameters of water trough 34.

Figure 5:
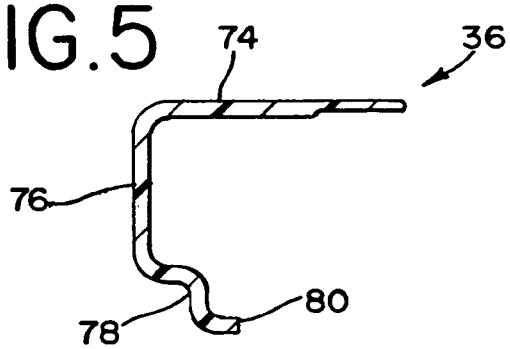
FIG. 5 is a cross-sectional view of the mating member illustrated in FIG. 2 taken along section line V-V.

A cross-sectional view of mating member 36 taken along section line V-V of FIG. 2 is illustrated in FIG. 5. Mating member 36 includes a top portion 74, a side portion 76, and a contoured mating portion 78. A top portion 74 overlies trough 34 closing the inner channel of the trough. Side portion 76 is spaced apart from outer wall 56 of trough 34 and abuts against struts 44 and portions of end walls 46. Contoured mating portion 78 includes a bottom edge 80 that mates with bottom edge 64 of outer wall 56.

Figure 6:
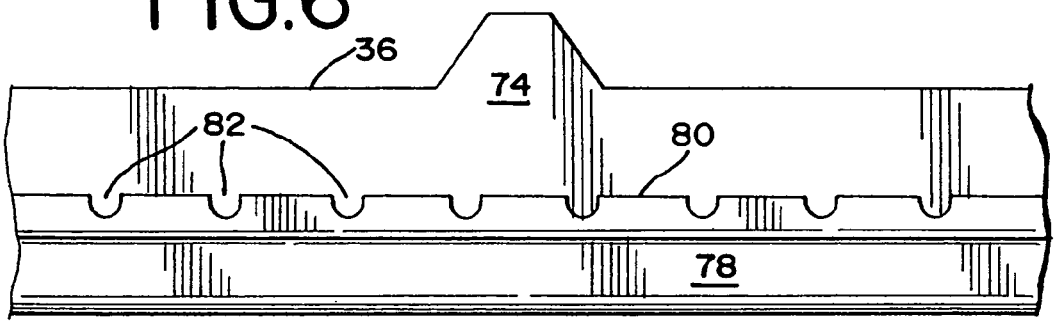
FIG. 6 is a partial bottom view of the mating member illustrated in FIG. 2.

A partial bottom view of mating member 36 is illustrated in FIG. 6. Bottom edge 80 includes a plurality of cut away portions or cut outs 82. Cut outs 82 are semi-circular cutouts that are spaced apart along bottom edge 80. In the particular illustrated embodiment, cut outs 82 are spaced apart at regular intervals along bottom edge 80. In accordance with an embodiment of the invention, cut outs 82 can also be spaced at irregular intervals along bottom edge 80 and can be configured in a variety of geometric shapes. For example, cut outs 82 can be oval-shaped, elongated slots, squares, rectangles, and the like.

Figure 7:
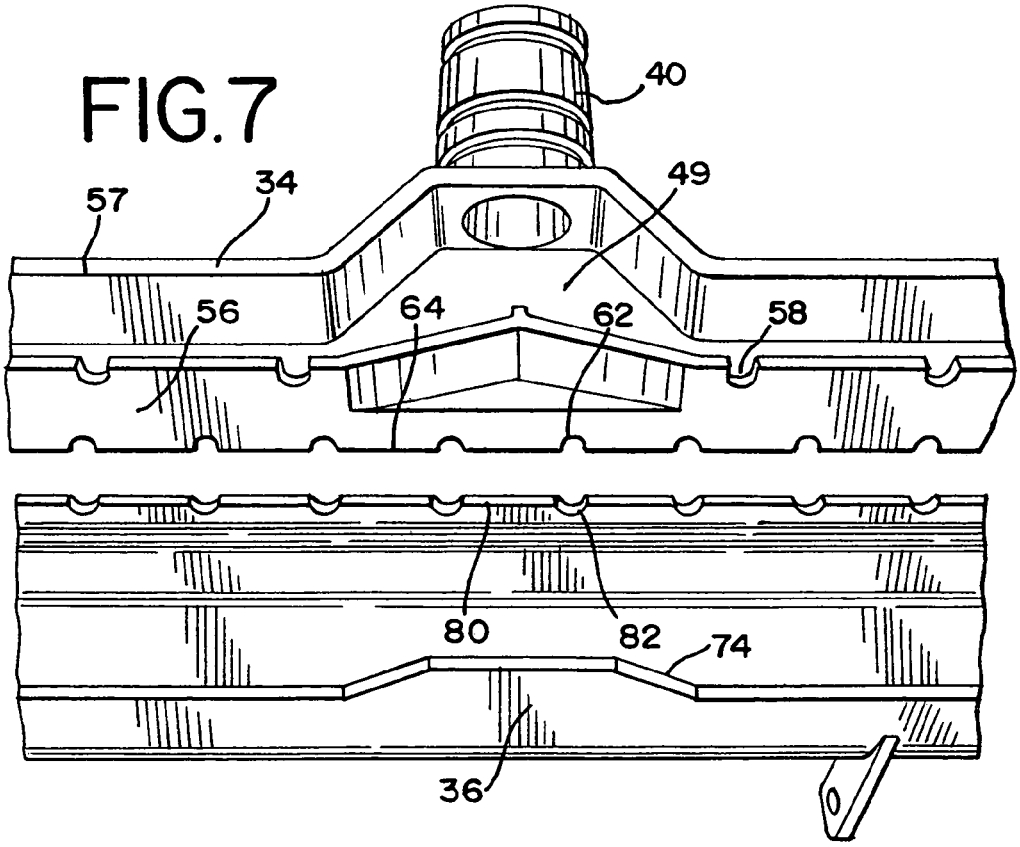
FIG. 7 is a partial perspective view of a portion of the trough and a portion of the mating member illustrated in FIG. 2.

FIG. 7 illustrates portions of trough 34 and mating member 36 in which channels 62 and cut outs 82 are aligned prior to assembly. Each of channels 62 aligns with one of cut outs 82 as mating member 36 and trough 34 are fitted together prior to insertion into housing 38. During assembly, bottom edge 80 of mating member 36 and bottom edge 64 of outer wall 56 are brought together, such that cut outs 82 align with channels 62 and top portion 74 of mating member 36 slides over the top of outer wall 56 and inner wall 57 of trough 34. FIG. 7 also illustrates the inclined V-shape in outer wall 56 in front of inlet 40, which helps divide the flow of water down both sides of trough 34.

Figure 8:
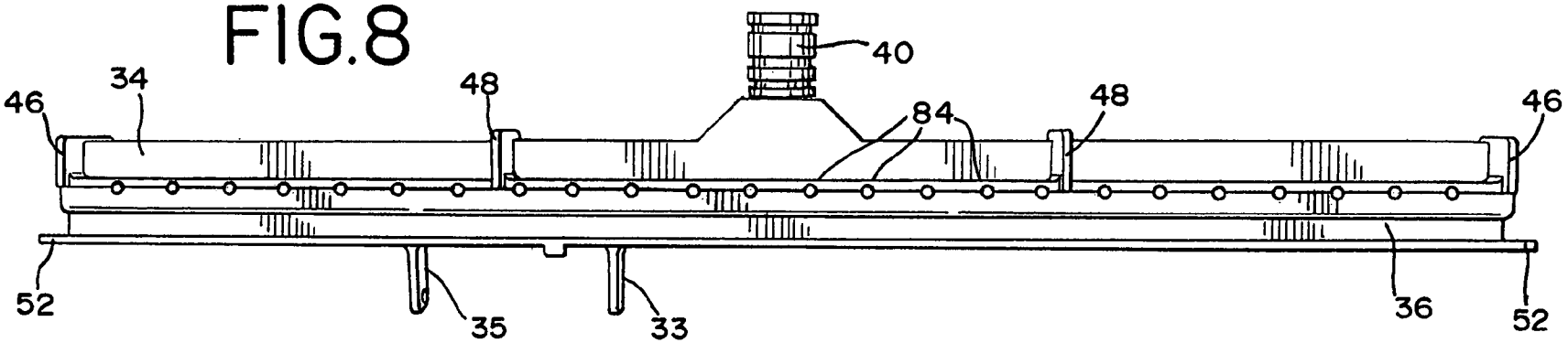
FIG. 8 is a bottom view of the trough and the mating member illustrated in FIG. 2 as assembled.

A bottom assembled view of trough 34 and mating member of 36 is illustrated in FIG. 8. Once the bottom edge 80 of mating member 36 and bottom edge 64 of outer wall 56 are mated, a series of water outlet openings 84 are created along the bottom of the assembly. In the illustrated embodiment, water outlet openings are substantially circular and regularly spaced along the bottom edge of the assembly. Alternatively, water outlet openings can be irregularly spaced along the bottom edge of the assembly and the shape can differ from the circular openings illustrated in FIG. 8. For example, water outlet openings 84 can be oval-shaped, rectangular-shaped, square-shape, and the like. The particular geometry of water outlet openings 84 will be determined by the shape of cut outs 82 in mating member 36 and the cross-sectional shape of channel 62 in trough 34.

Trough 34 and mating member 36 are configured to be readily assembled together, such that the various portions of the trough and mating member fit snuggly together. Further, referring back to FIGS. 2 and 5, screws or other fastening devices can be fixed through side portions 76 of mating member 36 and into holes in inserts 45 in struts 44 of trough 34. In this manner, the mating member and trough are physically attached to one another to ensure that the components do not inadvertently become separated during operation of the ice machine.

Figure 9:
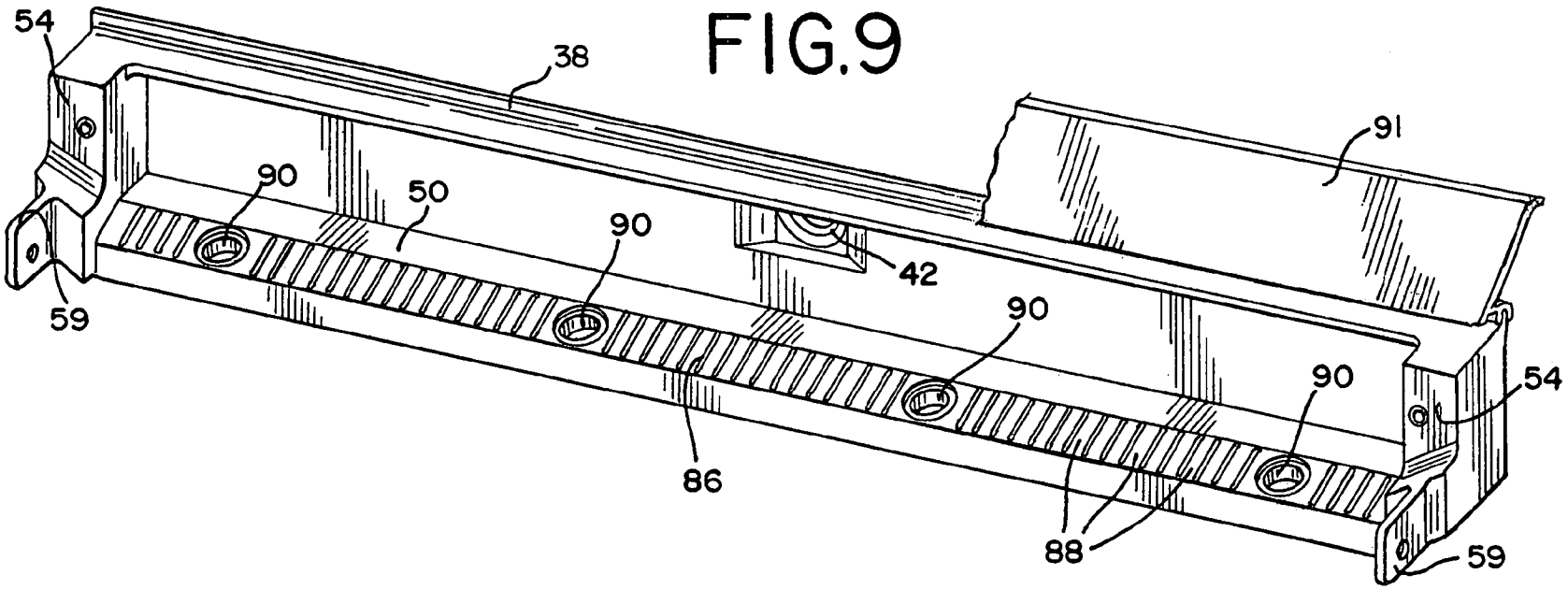
FIG. 9 is a perspective view of the housing illustrated in FIG. 2.

A perspective view of housing 38 is illustrated in FIG. 9. A spillway 86 extends away from housing floor 50 at a predetermined slant angle. Spillway 86 has a fluted surface that includes a plurality of channels 88. Spillway 86 further includes openings 90 for securing housing 38 to an ice-forming mold positioned below water distributor 32. Spillway 86 is inclined away from housing floor 50 to facilitate the flow of water from water outlet openings 84 and onto an ice-forming mold. In the illustrated embodiment, channels 88 are created by forming a series of flutes in the surface of spillway 86. Each flute is bordered by a ridge created in the surface of spillway 86. Alternatively, channels 88 can be formed by depressions or indentations, or the like, created in the surface of spillway 86.

A top panel 91 (shown in partial view) rests against an upper lip of housing 38. Top panel 91 cooperates with framing members to shield rear portions of water distributor 32 once it is installed in an ice machine (see FIG. 13). Also, as seen in FIG. 9, the lower surfaces of landings 54 are sloped toward spillway 86. Accordingly, any water leaking around the edges of mating member 36 will be directed by landings 54 onto spillway 86.

Figure 10:
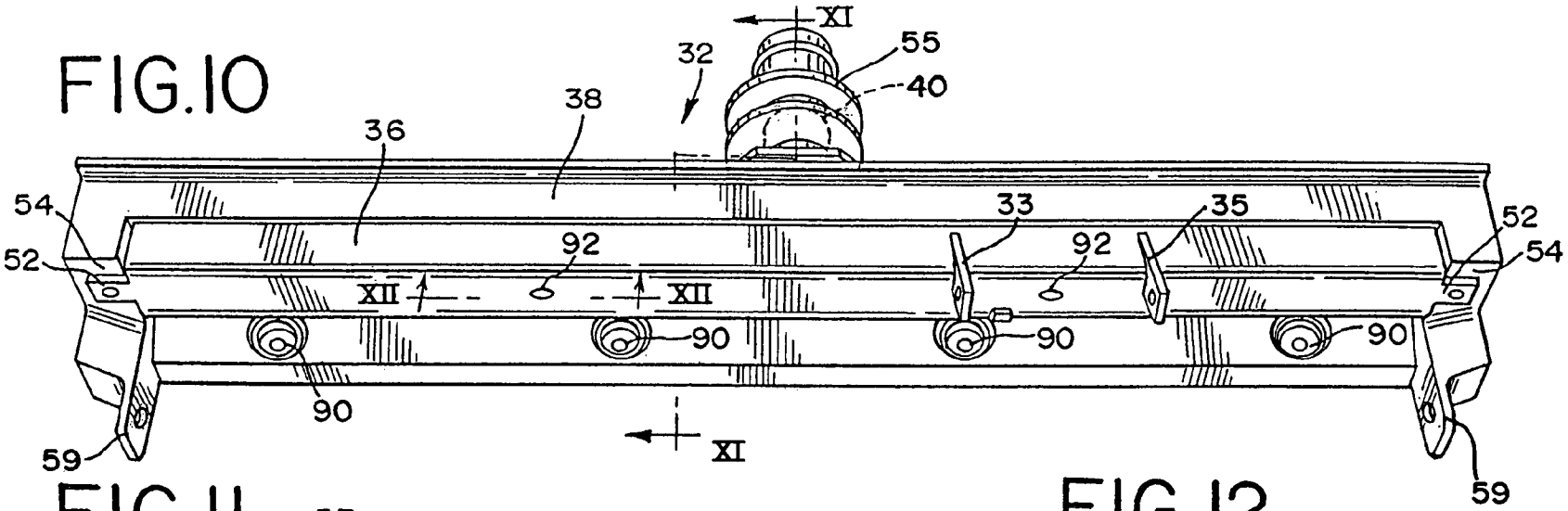
FIG. 10 is an assembled view of the water distributor illustrated in FIG. 2.

An assembled perspective view of water distributor 32 is illustrated in FIG. 10. The assembly of trough 34 and mating member 36 illustrated in FIG. 8 is inserted into housing 38, such that wing panels 52 of mating member 36 abut against landings 54 of housing 38. Screws or other fastening devices can be used to secure mating member 36 to housing 38. Also, screws or other fastening devices can be inserted through opening 92 to attach mating member 36 to struts 44 (shown in FIGS. 2 and 3). As assembled, water distributor 32 can be inserted into an ice machine and a water supply line can be attached to water inlet tube fitting 55.

Figure 11:
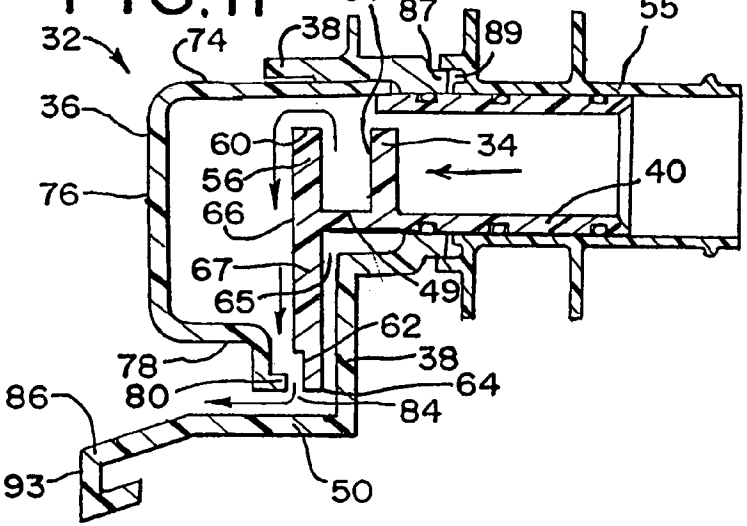
FIG. 11 is a cross-sectional view of the assembled water distributor illustrated in FIG. 10 taken along section line XI-XI of FIG. 10.

A cross-sectional view of water distributor 32 taken along section lines XI-XI of FIG. 10 is illustrated in FIG. 11. Top portion 74 of mating member 36 overlies outer wall 56 and inner wall 57 of trough 34 and also a portion of water inlet tube 40. Housing 38 includes a tongue portion 87 that abuts against water inlet tube 40 and engages a groove 89 in fitting 55. Side portion 76 of mating member 36 is spaced apart from flow surface 66. Mating portion 78 bends inward toward flow surface 66 and cooperates with channels 62 to form a flow path leading to water outlet openings 84.

In operation, as designated by the arrows in FIG. 11, water flows in through water inlet tube 40. The water flows into trough 34 and fills the reservoir formed by floor 49, outer wall 56, inner wall 57, and end walls 46. Once the water level reaches upper edge 60 of outer wall 56, it flows through weirs 58 (including weirs 68 and 70) and then downward along flow surface 66. Flow plate 67 supports flow surface 66 and forms a continuous lower portion of outer wall 56. In one embodiment of the invention, the flow of water over flow surface 66 and flow plate 67 is regulated by weirs 58 such that a laminar flow is produced water turbulence on flow surface 66 is avoided. When the water reaches the lower portion of flow surface 66, it flows into channels 62. Channels 62 are configured to direct the flow of water down to openings 84 and onto housing floor 50. As previously described, portions of end walls 46 and legs 48 abut against housing floor 50, such that water outlet openings 84 are positioned above and spaced apart from housing floor 50.

Any water from trough 34 that leaks around the coupling between inlet tube 40 and mating member 38 and fitting 55 is directed to housing floor 50 through a backchannel 65. Tongue portion 87 prevents water leakage outside of housing 38. Water flowing in backchannel 65 is recombined with water flowing over flow surface 66 at bottom edge 64 of outer wall 56. Backchannel 65 is created by the abutment of endwalls 46 and legs 48 of trough 34 (FIG. 3) with housing 38, which stands off trough 34 from housing 38. Accordingly, water tight seals between trough 34 and mating member 36 are unnecessary After the water exits water outlet openings 84, it flows along housing floor 50 below bottom edge 80 of trough mating member 36 and onto spillway 86. Once the water reaches spillway 86, it flows through channels 88 and over edge 93 of spillway 86. In accordance with one embodiment of the invention, spillway 86 is positioned below water outlet openings 84, such that channels 88 (shown in FIG. 9) cooperate with outlet openings 84 to provide an evenly distributed stream of water flowing over edge 93 of spillway 86. In a further embodiment of the invention, weirs or slots 58 cooperate with flow surface 66, water outlet openings 84 and spillway 86 to create a non-turbulent stream of water flowing over edge 93 of spillway 86. Those skilled in the art will appreciate that delivery of a non-turbulent stream of water from water distributor 32 improves the clarity of ice formed in an ice-forming mold by minimizing trapped air in the stream of water. Further, ice forming efficiency is improved by providing a uniform flow of water across the ice-forming mold.

Figure 12:
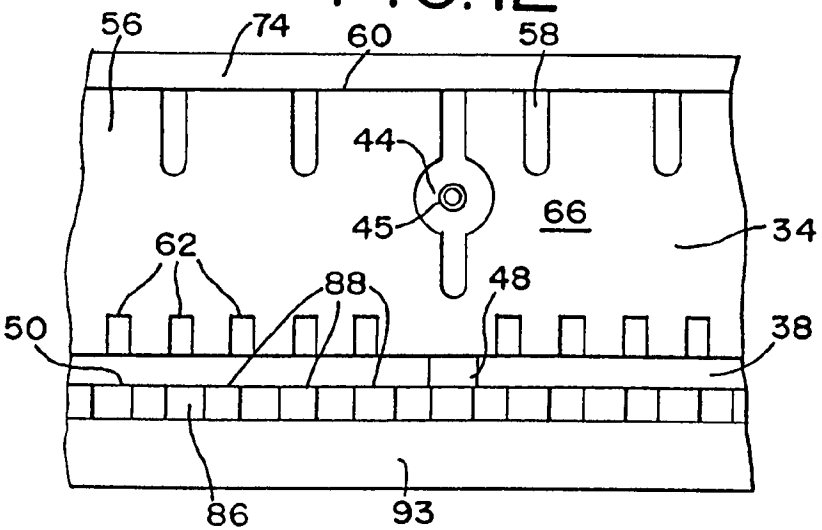
FIG. 12 an enlarged and partial cutaway view of the assembly illustrated in FIG. 10 taken along section line XII-XII of FIG. 10.

FIG. 12 is a partial cutaway view of water distributor 32 taken along section line XII-XII of FIG. 10. The cutaway view shows the relative positioning of trough 34 within housing 38. As illustrated in the cutaway view, one of legs 48 rests on housing floor 50 and, in combination with end walls 46 (shown in FIGS. 2, 3, and 8), supports trough 34 within housing 38. Also, one of struts 44 abuts against the inner wall of mating member side portion 76. In this manner, channels 62 (and consequently water outlet openings 84) are generally aligned with channels 88 in spillway 86. Top portion 74 of mating member 36 overlies upper edge 60 of outer wall 56 and allows water to flow through weirs 58 over flow surface 66 and down to channels 62.

Figure 13:
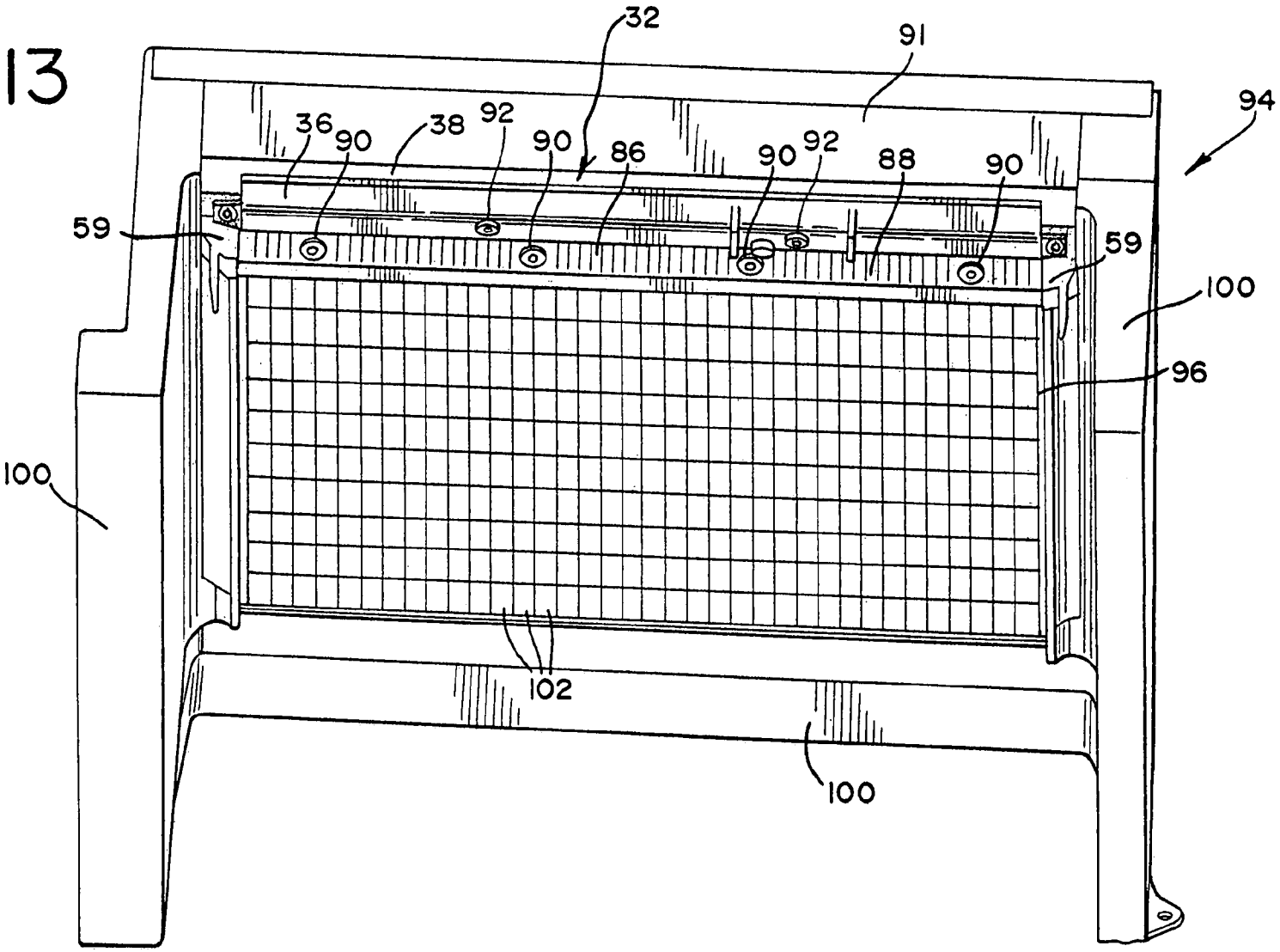
FIG. 13 is a schematic view of an ice-making assembly arranged in accordance with an embodiment of the invention that includes the water distributor illustrated in FIGS. 2-11 positioned above an ice forming mold.

A perspective view of an ice-making assembly arranged in accordance with an embodiment of the invention, is illustrated in FIG. 13. In ice-making assembly 94, water distributor 32 is positioned above an ice-forming mold 96. Housing 38 is attached to ice-forming mold 96 by fastening devices positioned in openings 90 of spillway 86. Brackets 59 are configured to extend parallel to frame members 100 and provide support for a water curtain (not shown) that hangs in front of ice-forming mold 96. Top panel 91 closes off the rear portion of water distributor 32 from the active water flow and ice forming process ongoing within the ice making machine.

Ice-forming mold 96 includes a plurality of cells 102 arranged in rows and columns. Clear ice cubes are formed in each of cells 102 during operation of the ice machine. In the illustrated embodiment, channels 88 and spillway 86 generally align with the columns of ice-forming mold 96. Alignment of channels 88 to the columns of ice-forming mold 96 facilitates delivery of the uniform flow of water from spillway 86 down each column and into cells 102. In a manner known to those skilled in the art, excess water flows into a sump and is recycled to water distributor 32 by means of a pump and a water recirculation line.

Figures 14A, 14B:
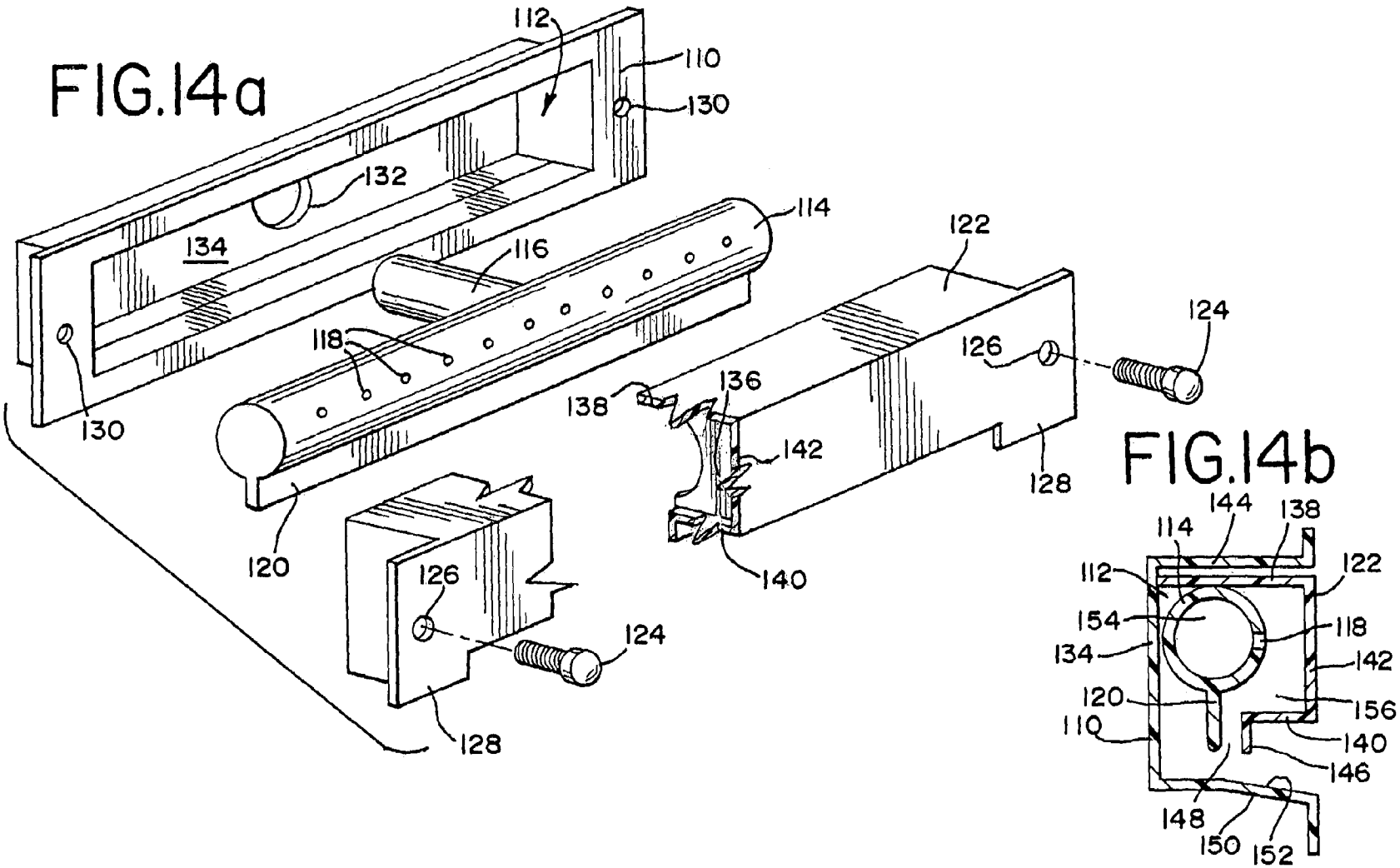
FIG. 14*a* is an exploded view of a water distributor in accordance with another embodiment of the invention.
FIG. 14*b* is a sectional view of the water distributor illustrated in FIG. 14*a*.

A water distributor arranged in accordance with another embodiment of the invention is illustrated in FIGS. 14*a* and 14*b*. The water distributor includes a housing 110 having a cavity 112, and an elongated water distribution tube 114 having a water inlet tube 116, a plurality of water outlet openings 118, and a flow plate 120. The water distributor further includes a mating member 122 that attaches to housing 110 to enclose elongated water distribution tube 114 within cavity 112. Mating member 122 is coupled to housing 110 by retaining screws 124 that insert through holes 126 in flanges 128 of mating member 122 and into threaded openings 130. When water distribution tube 114 is positioned within cavity 112, water inlet tube 116 inserts into opening 132 in a rear wall 134 of cavity 112. Mating member 122 includes one or more retaining ribs 136 that press against water distribution tube 114 when mating member 122 is coupled to housing 110.

Mating member 122 is generally shaped in the form of an elongated channel member having an upper arm 138 and a lower arm 140. Upper arm 138 and lower arm 140 are separated by a vertical section 142. The height of vertical section 142 is generally determined by the diameter of water distribution tube 114 in order that mating member 122 can be fitted against water distribution tube 114 when mating member 122 and housing 110 are brought together.

A sectional view of the water distributor shown in FIG. 14*a* is illustrated in FIG. 14*b*. Water distribution tube 114 is enclosed within cavity 112 by mating member 122. Upper arm 138 of mating member 122 inserts between water distribution tube 114 and an upper wall 144 of housing 110. Lower arm 140 resides generally below water outlet openings 118. A lip 146 depends from lower arm 140 of mating member 122 and resides in spaced relationship with flow plate 120. The combination of flow plate 120 and lip 146 forms an elongated water outlet 148. A slanted member 150 of housing 110 resides below elongated water outlet 148 and includes a water receiving surface 152.

In operation, water entering water distribution tube 114 through water inlet tube 116 flows out outlet openings 118 and onto flow plate 120. The water flowing onto flow plate 120 flows through elongated water outlet 148 and onto water receiving surface 152. Slanted member 150 directs the water impinging on water receiving surface 152 onto an evaporator (not shown) positioned below slanted member 150.

Those skilled in the art will appreciate that the water distributor illustrated in FIGS. 14*a* and 14*b* can be positioned within the ice forming unit of an ice making machine in a similar manner to that illustrated in FIG. 13. Further, various modifications can be made to the water distributor without departing from the operational principles of the invention. For example, water outlet openings 118 can be positioned in various geometric patterns in addition to the linear pattern illustrated in FIG. 14*a*. Further, water outlet openings 118 can reside in the end walls of water distribution tube 114. Also, mating member 122 can be coupled to housing 110 by a variety of attachment devices, including clamps, removable clips, fasteners, and the like.

Accordingly, the water distributor arranged in accordance with the embodiment illustrated in FIGS. 14*a* and 14*b* includes a first chamber 154 and a second chamber 156. Second chamber 156 is formed in the space created when mating member 122 is coupled to housing 110. Once assembled, vertical section 142 stands off from water distribution tube 114 by a distance that is at least partially determined by the length of upper arm 138. In the embodiment illustrated in FIGS. 14*a* and 14*b*, water distribution tube 114 is configured to receive an inflow of water and to distribute the water laterally and to controllably release the water through water outlet openings 118. Second chamber 156 is configured to receive the water flowing through water outlet openings 118 from first chamber 154 and to controllably release the water through elongated water outlet 148 onto receiving surface 152. Although water outlet opening 148 is illustrated as an elongated opening, flow plate 120 and lower arm 140 can be configured to form a series of openings similar to the preferred embodiment described above, or otherwise form partitions through which water from tube 114 can be discharged.

Figures 15A, 15B:
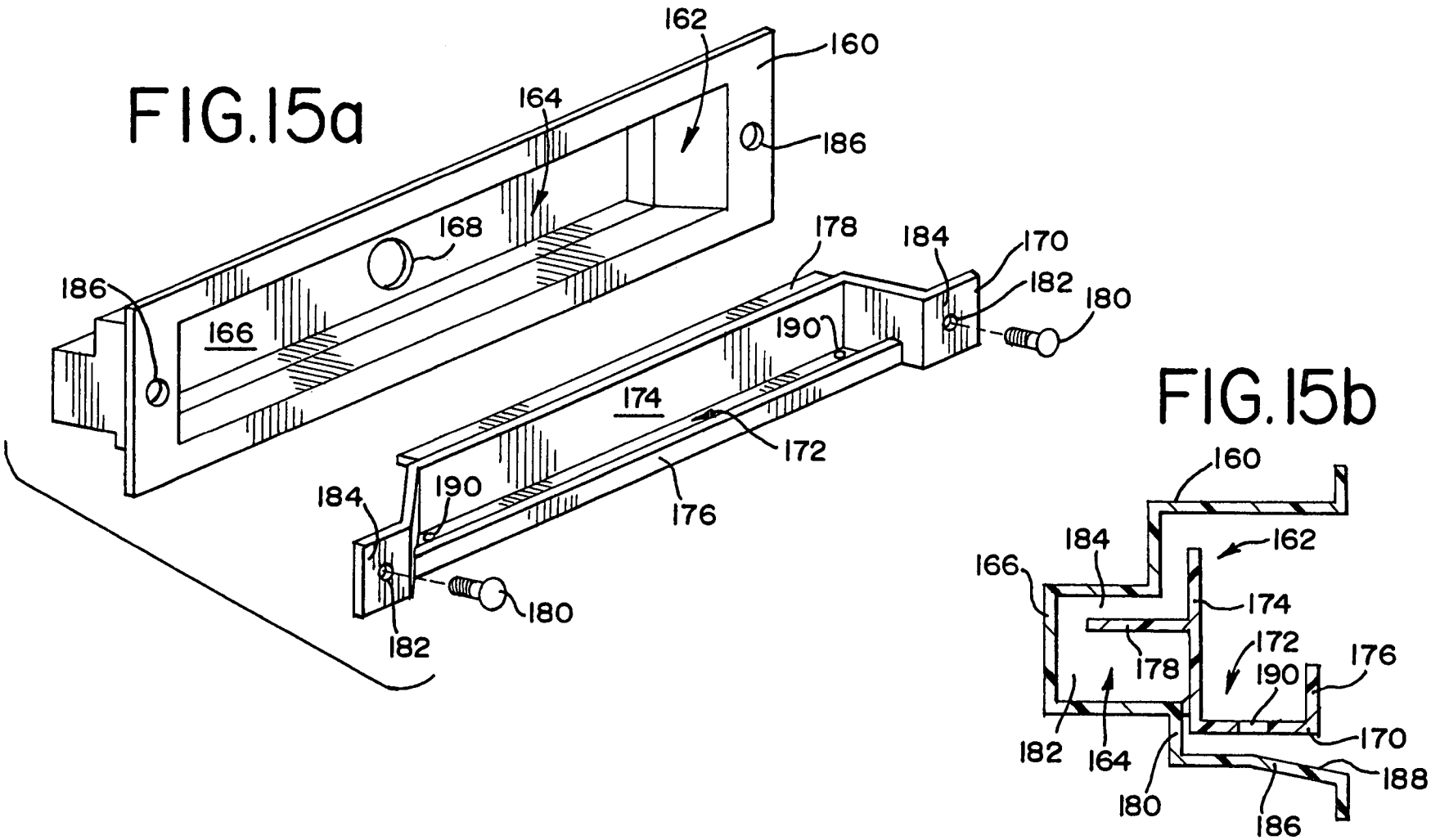
FIG. 15*a* is an exploded view of a water distributor in accordance with yet another embodiment of the invention.
FIG. 15*b* is a sectional view of the water distributor illustrated in FIG. 15*a*.

A water distributor configured in accordance with a further embodiment of the invention is illustrated in FIGS. 15*a* and 15*b*. The water distributor includes a housing 160 having a cavity 162. A channel 164 resides in a rear portion of cavity 162. Channel 164 has a rear wall 166 that includes an opening 168. A mating member 170 includes a trough 172 having a backwall 174 and a frontwall 176. A lateral fin 178 extends from backwall 174 in a direction away from trough 172. Mating member 170 is coupled to housing 160 by retaining screws 180 that insert through holes 182 in flanges 184 and into threaded openings 186 in housing 160.

A sectional view of the water distributor shown in FIG. 15*a* is illustrated in FIG. 15*b*. When mating member 170 is inserted into cavity 162, a lower portion of backwall 174 abuts a ledge 180 of housing 160. Lateral fin 178 extends into channel 164 and partitions channel 164 into a chamber 182 and a passageway 184. Front wall 176 of mating member 170 is positioned over a slanted member 186 of housing 160.

In operation, water entering housing 160 through opening 168 fills chamber 182 and flows through passageway 184 overflowing backwall 174 and into trough 172. When sufficient water overflows backwall 174, the water level rises in trough 172 eventually overflowing frontwall 176. Water overflowing frontwall 176 flows along the outer surface of frontwall 176 and onto a receiving surface 188 of slanted member 186. As illustrated in FIGS. 15*a* and 15*b*, the vertical height of frontwall 176 is substantially less than the vertical height of backwall 174.

Trough 172 includes drain holes 190 located at terminal ends of trough 172. Drain holes 190 ensure that water does not remain in trough 172 when the flow of water to the water distributor is either interrupted or terminated.

In accordance with an embodiment of the invention, the water distributor illustrated in FIGS. 15*a* and 15*b* includes a first chamber, chamber 182 that is configured to receive an inflow of water and to distribute the water laterally and to controllably release the water through passageway 184 and over backwall 174. The water distributor is further configured such that mating member 170 includes a second chamber (trough 172), that is configured to receive water from chamber 182 and to controllably release the water onto receiving surface 188. As illustrated in FIGS. 15*a* and 15*b*, mating member 170 can be detached from housing 160 in a direction perpendicular to the direction of lateral water distribution. Those skilled in the art will appreciate that mating member 170 can be coupled to housing 160 by a variety of means other than screws 180. For example, mating member 170 can be coupled to housing 160 by clamps, removable clips, fasteners, and the like.

The water distributor of the various illustrated embodiments minimizes the use of components that restrict the flow of water and increase the water pressure within the water recirculation system of an ice machine. By avoiding the build up of excessive water pressure in the water distributor, less pumping power is needed to circulate water though the water distributor. Accordingly, a relatively smaller water pump can be used in comparison to pumps found in commercial water distribution systems of the prior art. The use of a small water pump that consumes less energy reduces the overall operating cost of the ice machine.

In one embodiment of the invention, the components of the water distributor are preferably acrylonitrile-butadiene-styrene (ABS) molded plastic articles that can be formed by a variety of molding processes. Alternatively, various types of plastics, such as poly-vinyl-chloride (PVC), MYLAR®, TEFLON®, and the like, can be used to form the components of the water distributor. In yet another alternative, some or all of the various components of the water distributor can be metal or metalized plastic, or the like. Further, some or all of the components of the water distributor can be formulated with Antimicrobial ALPHASAN® to reduce the formation of a biofilm on surfaces that come in contact with water.

Those skilled in the art will appreciate that the present invention provides a water distributor that is easy to manufacture and assemble. Further, the water distributor is easy to disassemble and clean because only two screws have to be removed to disassemble the parts, and those screws could preferably be thumb screws. Also, in the preferred embodiment, no holes require brushing. Further, all of the surfaces that need to be cleaned are readily viewable. In the instant water distributor, the distributor is disassembled such that the water outlet openings come apart in two halves. In addition, no o-rings or other internal seals are needed to seal the mating member to the trough. As described above, any water leaks are captured within the housing and directed to the ice-forming mold.

Although the water distributor has been described including three distinct components, a trough, a mating member, and a spillway, those skilled in the art will appreciate that other configurations are possible. For example, the water distribution function can be carried out by the trough and mating member independent of a frame or other water handling structures. In this case, extensions or other mounting members can be integrated into a trough or the mating member, or both, to facilitate attachment of the trough and mating member to framing members within the clear ice-making machine.

Additionally, although the mating member or mating member that couples to the trough has been described in terms of particular geometric configurations, other arrangements are possible. For example, a mating member can be configured that abuts against the trough to form water outlet openings, while having an upper edge terminating without extending over the top of the trough.

Further, the function of the mating member can be accomplished by more than one unitary structural component. For example, a separate member can be configured to mating member the trough, and a separate member can be configured to mate with the outer wall to form water outlet openings. Accordingly, the particular geometric configuration and arrangement of the trough and mating member can vary from that illustrated in the described embodiment.

Those skilled in the art will appreciate that the trough can also be fabricated to have geometry that differs from the illustrated embodiments. For example, the trough can be sectioned into several sections or compartments that each provide water reservoirs for water delivery to the ice-forming mold. Further, rather than having a square cross-sectional configuration, the trough can have a rounded, or semi-tubular configuration, or the like.

Those skilled in the art will appreciate that the trend in the ice machine industry is toward manufacture of equipment that offers levels of cleanliness sufficient to satisfy stringent government regulations for food preparation and handling equipment. In their continuing effort to meet these high standards, the inventors contemplate further improvements in preferred designs of the water distributor disclosed herein.

Thus, it is apparent that there has been described in accordance with an embodiment of the invention, an ice machine having an ice-making assembly that includes a water distributor that fully provides the advantages described above. Those skilled in the art will recognized, however, that various modifications can be made without departing from the spirit of the invention. For example, the ice-making assembly can be used in domestic ice-making equipment in addition to commercial ice machines. Accordingly, it is intended that all such variations and modifications be included within the appended claims and equivalents thereof.

The invention claimed is:

1. An ice machine having an ice making assembly, the ice making assembly comprising:

(a) an ice-forming mold;

(b) a water distributor positioned above the ice-forming mold, the water distributor including a trough having an inner wall and an outer wall, the outer wall having a series of weirs in an upper edge and a plurality of channels in a bottom edge, wherein the series of weirs regulates a flow of water thereover;

(c) a mating member overlying the trough and spaced apart from the outer wall, the mating member having a plurality of cut outs in a bottom edge thereof, wherein the plurality of cut outs cooperate with the plurality of channels to form water outlet openings; and (d) a housing supporting the trough and the mating member and having a spillway positioned below the water outlet openings, wherein the spillway includes a plurality of flutes configured to provide a generally even distributed water stream over the ice-forming mold.

2. The ice machine of claim 1 wherein the spillway comprises an inclined surface having a plurality of channels therein.

3. The ice machine of claim 2 wherein the ice-forming mold comprises a plurality of cells arranged in rows and columns, and wherein each column is aligned with one of the plurality of channels in the spillway.

4. The ice machine of claim 3 wherein the plurality of cut outs mate with the plurality of channels in the bottom edge of the outer wall to form substantially circular water outlet openings.

5. The ice machine of claim 4 wherein the series of weirs, the water outlet openings, and the plurality of flutes cooperate to provide an evenly distributed stream of water to the ice-forming mold.

6. The ice machine of claim 1 wherein the housing is coupled to the ice-forming mold by a plurality of fastening devices in the spillway.

* * * * *